US005815579A

United States Patent [19]

Boyden

[11] Patent Number: 5,815,579

[45] Date of Patent: Sep. 29, 1998

[54] PORTABLE SPEAKERS WITH PHASED ARRAYS

[75] Inventor: James H. Boyden, Los Altos Hills, Calif.

[73] Assignee: Interval Research Corporation, Palo Alto, Calif.

[21] Appl. No.: 565,951

[22] Filed: Dec. 1, 1995

Related U.S. Application Data

[63] Continuation-in-part of Ser. No. 400,901, Mar. 8, 1995.

[51] Int. Cl.[6] ..... H04R 5/02; H04R 25/00

[52] U.S. Cl. ..... 381/301; 381/373; 381/385; 381/309

[58] Field of Search ..... 381/17, 25, 183, 381/187, 97, 24, 74

[56] References Cited

U.S. PATENT DOCUMENTS

| | | | |
|---|---|---|---|
| 3,114,105 | 12/1963 | Neumiller . | |
| 3,370,236 | 2/1968 | Walker . | |
| 3,894,196 | 7/1975 | Briskey | 381/68.6 |
| 3,916,312 | 10/1975 | Campbell . | |
| 4,110,583 | 8/1978 | Lepper . | |
| 4,490,842 | 12/1984 | Watanabe . | |
| 4,539,700 | 9/1985 | Sato . | |
| 4,726,070 | 2/1988 | Buzzi . | |
| 4,783,814 | 11/1988 | Foley | 381/67 |
| 5,138,663 | 8/1992 | Moseley | 381/71 |
| 5,251,326 | 10/1993 | Silverman . | |
| 5,371,799 | 12/1994 | Lowe et al. | 381/17 |

*Primary Examiner*—Forester W. Isen

[57] ABSTRACT

A wearable speaker system which provides improved quality audio response and which does not interfere with the wearer's activities or block environmental sounds is disclosed. Transducer arrays, e.g. pairs of speakers, are situated in a wearable garment, headband, or the like and positioned on opposite sides of the wearer's head. In one embodiment, the transducer arrays share a common enclosure and are driven 180° out of phase, so that back pressures cancel and low frequency response is enhanced. In another embodiment, two open-ended enclosures are provided, each with its own transducer array. In another embodiment, linear arrays of transducers are provided with appropriate time-delays between the audio signals. The speaker system is connected to or in communication with a conventional source of audio signals, such as a radio, tape player, CD player, cellular telephone or the like.

39 Claims, 5 Drawing Sheets

PORTABLE SPEAKERS WITH PHASED ARRAYS

CROSS REFERENCE TO RELATED APPLICATIONS

This is a continuation-in-part of United States patent application Ser. No. 08/400,901, filed Mar. 8, 1995, entitled "Portable Speakers With Enhanced Low Frequency Response".

TECHNICAL FIELD

The present invention relates to portable entertainment and personal communication systems, particularly wearable audio systems.

BACKGROUND OF THE INVENTION

There are many situations where it is desirable to provide audio output for personal use to be worn or carried near the body. This audio output could be used for portable entertainment, personal communications, and the like. These personal and portable communication and entertainment products include, for example, cellular and portable telephones, radios, tape players, and audio portions of portable video systems and personal monitors.

The audio output for many of these systems is typically directed to the wearer through the use of transducers physically positioned in the ear or covering the ear, such as earphones and headphones. Earphones and headphones, however, are often uncomfortable to use for long periods of time. Also, they can block or attenuate environmental sounds causing the wearer to lose contact with the surroundings. In this regard, this can compromise safety considerations if the wearer is engaging in activities such as running, driving a vehicle or operating machinery.

One common use of audio systems with earphones and headphones involves exercise and athletic events. It is quite common to see people running or exercising with headphones or earphones positioned in or covering their ears. Not only is this dangerous since the person often loses contact with external sounds and surroundings, but the earphones and headphones are subject to being dislodged as a result of the activity. Moreover, perspiration and inclement weather could affect the integrity of the speakers and audio system.

It is commonly desired to provide stereo audio output from these portable entertainment and personal communication systems. Also, a stereo audio output may be provided without earphones or headphones by arranging small loud speakers (a/k/a transducers) on the body. The speakers, however, are not able to create broad-band high fidelity sound, particularly in the low frequency ranges. In this regard, loud speaker transducers are usually mounted in enclosures to confine the acoustic radiation from the rear portions of the transducer so that the radiation does not combine with out-of-phase radiation from the front portions of the transducer. Without such an enclosure, there is a significant reduction of net radiated intensity, especially in the low frequency audio ranges.

For wearable speakers, the requirement of an enclosure creates a problem. In general, the volume of the enclosure will be quite small and its acoustic stiffness will dominate the speaker behavior. The result will be a high resonance frequency and consequently a poor low frequency response.

SUMMARY OF THE INVENTION

It is an object of the present invention to provide an improved audio system for portable entertainment and personal communication systems. It is another object of the present invention to provide a portable audio system which provides high quality sound, particularly at low audio frequencies.

It is another object of the present invention to provide a wearable audio system which can be easily worn and does not interfere with the person's activity, whether sports related or otherwise. It is a still further object of the present invention to provide a wearable audio system which does not require the speakers to be positioned in or covering the wearer's ears and thus overcome a number of the problems and drawbacks with present systems.

It is also an object of the present invention to have personal speakers which are conformal, that is that can be adapted to the shape of the body for reasons of comfort and for considerations of fashion and social acceptability.

The present invention fulfills these objects and overcomes the problems with known systems by providing a personal audio system which provides high quality sound at all audio frequencies and a wearable configuration which does not interfere with the person's activity and does not block environmental sounds. In accordance with the present invention, portable speakers are provided which are wearable on the person's body and provide sounds to the ears without the necessity of actually being positioned in or covering the ears.

The present invention utilizes one or more speakers positioned on opposite sides of the wearer's head each emitting sounds which can be heard by both ears. In one embodiment, the invention uses the unique combination of the radiation characteristics of dipole (doublet) sources with certain placement of the transducers on the body.

There are two basic types of the dipole embodiment of the present invention. In a first type ("Type I") the transducers are coupled together in one common sealed enclosure and driven 180° out-of-phase at low frequencies. Two or more transducers could be utilized, as desired. Since the transducers share a common enclosure, the back pressures cancel and the transducers behave as though they were individually mounted on an infinite volume enclosure. This enhances the low frequency response to the wearer's ears.

In the second type ("Type II"), two enclosures are provided, each open at one end or having a vent to the atmosphere. The transducer (which may consist of two or more arrayed transducers) is mounted in each enclosure and the enclosures are positioned on the shoulders or lapel of the wearer, such that the primary source, i.e. the transducer, and the vent are placed respectively at substantially different distances from the ear of the wearer, thus minimizing the cancellation of sound from the two sources which are 180° out of phase. Further, for best results one end should be placed as close to an ear as possible, consistent with the desired wearable configuration.

In either Type I or II, the enclosures can be hollow or filled with an acoustically transparent material, such as open-cell foam. The enclosures also could be integrated into various types of clothing, such as vests, jackets, shirts or shawls in order to meet the needs of fashion or to serve multiple purposes such as for carrying additional items. The invention has a wide variety of business, social and personal uses.

For sports-related and other activities, it may be preferred to position the transducers of either the Type I or II embodiment in a headband wearable on the wearer's head. The audio signal could be generated by a radio, CD, cellular telephone, portable telephone, cassette tape, etc., or any other conventional communication system. It is also possible to position the transducers in a cap, hat or helmet of some type which is wearable for the activity. The headband or the like preferably has an open-cell foam core, may contain one or more electronics modules, and positions the transducers adjacent or above the wearer's ears. (It is also possible for the enclosure to be filled simply with air.) In the Type I embodiment, internal coupling between the transducers, driven 180° out-of-phase at the two ears, sets up the "dipole" operation which enhances low frequency response. In the Type II embodiment, the two open-ended enclosures, each with its own transducer, provides a similar "dipole" operation.

The headband can be sealed by a thin diaphragm such as plastic film to protect electrical components and the foam core, and also can be covered with a terry cloth-type or similar material for comfort and moisture absorbability. Other forms of the headband or wearable apparatus could be utilized, depending on the activity, aesthetic effect and/or fashion design desired.

Another embodiment of the invention positions the transducers in linear arrays on opposite sides of the wearer's body. The other embodiments of the invention may, in some applications or designs have difficulty in realization due to limitations in size or maximum excursions of their diaphragms. Transducers of the type commonly used for headphones can be substituted in such circumstances due to their low free space resonance and low cost. Positioning the small speakers in linear arrays on the shoulders of the wearer allows the speakers to acoustically couple and yield effectively greater radiation. In order to avoid interference effects, the signals which drive the individual speakers are time-delayed with respect to one another. The linear array of speakers enhances low frequency response and improved high frequency smoothness.

The linear array embodiment could also be incorporated in a wearable garment or the like, or in one or more housings positioned in the wearer's body.

These and other objects, features and advantages of the present invention will become apparent from the following description of the invention when viewed in accordance with the attached drawings and appended claims.

BEST MODE(S) FOR CARRYING OUT THE INVENTION

For portable entertainment and personal communication systems, it is desirable to utilize frequencies below about 80 Hz in order to achieve high fidelity performance. This is comparable to what is commonly available from inexpensive earphones. Systems with small speakers of conventional design whose size is suitable for wearing are unsatisfactory for this purpose. Also, compensating techniques such as vented "bass reflex" enclosures cannot be used for this purpose. In small enclosures, the stiffness of the air in the sealed enclosure will dominate the behavior of the system.

It is known that loud speaker transducers should be mounted in enclosures to confine the acoustic radiation from the rear portions or surface of the transducer so that it does not combine with the out-of-phase radiation from the front portions or surface. If the two radiations combine, a large reduction of net radiated intensity results, especially at low frequencies.

The combination of transducer and enclosure behaves like a high pass filter whose turnover frequency depends on several system parameters. These parameters include the free-space resonant frequency of the transducer, and the volume "V" of the sealed enclosure which acts to produce a restoring force for the diaphragm of the transducer. For small enclosures, such as those which might be worn on the body, the enclosure stiffness is likely to dominate the system. The system resonance in this region varies approximately as $\sqrt{\sqrt{1/V}}$ and the low frequency turnover point becomes unacceptably high. For example, an enclosure whose dimensions are 10 cm×5 cm×1 cm would produce a turnover frequency on the order of 600 Hz. Acoustical radiation below that frequency falls at a rate of 12 dB per octave for constant input. At 60 Hz, for example, the radiation is reduced by 40 db with respect to that above 600 Hz.

Figure 1:
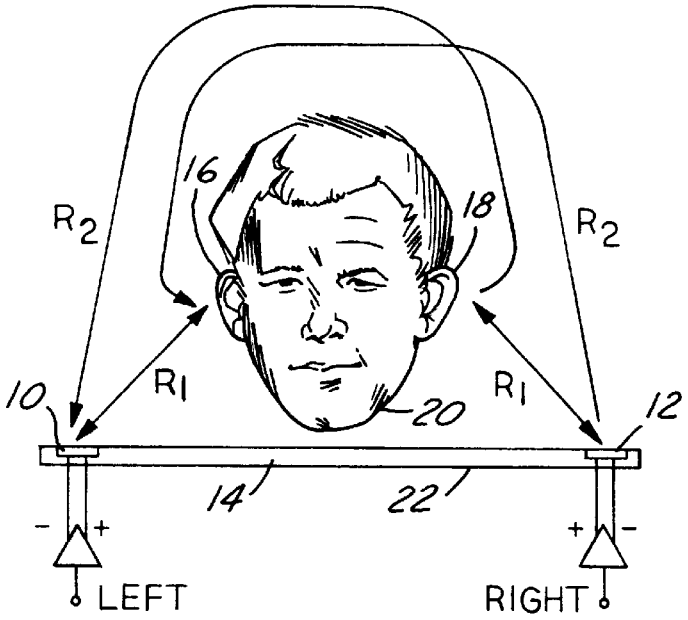
FIG. 1 illustrates the use of an embodiment of the present invention which utilizes a single closed enclosure.

In accordance with a first preferred device utilizing the present invention ("Type I"), a pair of transducers are provided which share a common enclosure. As shown in FIG. 1, the transducers 10 and 12 are positioned at the opposite end of a common closed or sealed enclosure 14. The transducers 10 and 12 are positioned on opposite sides of the wearer's head 20 and adjacent to the wearer's ears 16 and 18, respectively.

The distance $R_1$ from transducer 10 to the closest ear 16 of the wearer is much less than the distance $R_2$ from the out-of-phase transducer to that same ear. This results in a net amplitude at the ear 16 which is comparable to that from transducer 10 alone.

Since the two transducers 10 and 12 share a common enclosure, the back pressures cancel at frequencies whose wavelengths are much larger than the separation distance and the transducers behave individually as though they were mounted in an infinite volume enclosure, and are driven 180° out of phase. As a result, the frequency response of the transducers 10 and 12 approximate their free-space behavior, essentially unaffected by the enclosure volume, except at higher frequencies where enclosure-induced resonances may occur, but can be controlled by other means, such as the use of damping materials or sub-dividing the audio frequency range over two or more transducers. Normally the front radiations from the sources 10 and 12 will substantially cancel in a plane of symmetry perpendicular to the line joining the sources and are substantially reduced elsewhere compared with that of the same transducers with infinite baffles. Positioning the wearer's head 20 between the two sources allows each ear 16 and 18 to hear a substantial level of sound from the nearest source and much less from the other. Thus the two ears receive signals which are out-of-phase.

Enclosure 14 is either hollow, or filled with an acoustically transparent material. The filling material should not significantly load the transducer diaphragm due to acoustic back pressure. Preferably, an open-cell foam material is employed for this purpose. Whether or not the enclosure should remain empty or be filled, and the selection of the material in which to fill the enclosure, depends on a number of factors. The best choice for a given design will depend on the desired degree of stiffness required, the shape of the enclosure cavity, and additional factors such as the desire for high frequency damping to suppress undesired resonance within the enclosure. In this regard, it is easier to damp high frequencies than lower frequencies and this can be accomplished while at the same time maintaining good acoustic pressure coupling throughout the enclosure at low frequency.

The wall 22 of the enclosure is also made from or covered by a material which is substantially acoustically inert, that is, non-radiative and absorbing. Also, it is preferable that the material forming the wall 22 or outer covering, be flexible and in some cases soft so that it will not irritate the wearer. The material also should be lightweight and inexpensive. Heavy gauge woven impregnated fabrics and carbon fiber composites are two materials which meet these objectives, but other comparable materials could be utilized. High density closed-cell foam tape has been employed successfully in embodiments of these principles.

Figure 2:
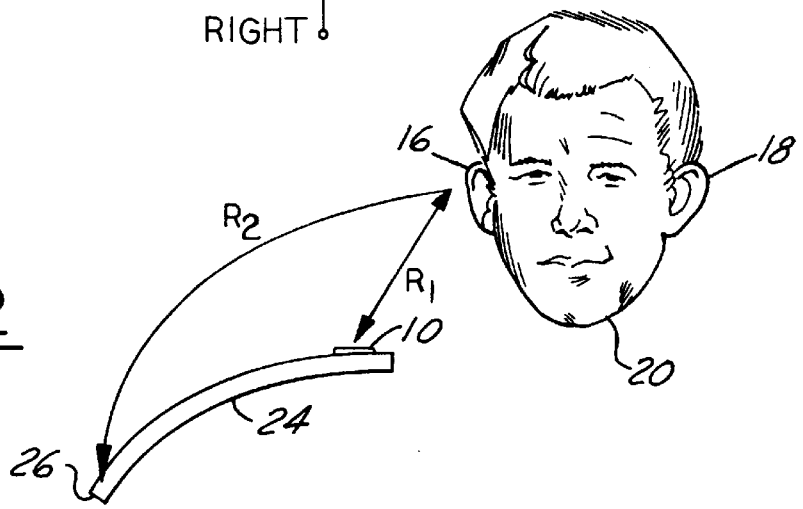
FIG. 2 illustrates the use of an embodiment of the present invention which utilizes an open ended enclosure.

FIG. 2 illustrates a second preferred device utilizing the invention ("Type II"). This device uses a transducer 10 in an open, i.e. vented, enclosure 24. (As explained later, the transducer 10 preferably comprises two or more arrayed transducers.) Generally, there should be two identical devices, one positioned on either side of the wearer's head adjacent to one of the wearer's ears. Also, for ease of wearing and use, the enclosure 24 preferably conforms to a portion of the wearer's body, such as a shoulder, lapel area or head.

The enclosure 24 is a thin narrow hollow enclosure which is open to the atmosphere at one end 26. The transducer 10 is situated near the ear 16 of the wearer, perhaps on his shoulder or temple, and the open end 26 is positioned as far away from the ear 16 as possible.

It is also possible for the open and closed ends of the enclosure 24 to be reversed if that provides a preferred wearable configuration. In that device, the open end 26 may serve as a primary source.

Tests have shown that "dipole" speakers in accordance with the present invention secure an audio enhancement at low frequencies. Compared with in-phase operation in sealed enclosures, the enhancement is on the order of 16–20 dB for frequencies on the order of 20–160 Hz. At approximately 100–200 Hz, which is close to the normal in-phase turnover frequency for the test enclosure, the sound levels became approximately equal. The in-phase levels exceed those of the out-of-phase situation, that is, the dipole case, at frequencies above that amount.

Certain resonances may occur at higher frequencies because of the finite size of the enclosures. In these embodiments, the resonances can be overcome by splitting the input signal between low and high frequencies with a multi-speaker system. This comprises a "tweeter-woofer" arrangement. In other systems, the entire audio range may be covered with the same transducers. In those situations, it may be necessary to suppress the resonances to a point where they become inaudible. This can be accomplished by selection of an appropriate damping material to partially or completely fill the enclosure, by using shaped vents, or by using electrical equalization of the input signals.

The dipole configuration for wearable speakers also results in reduced radiation at long distances due to the out-of-phase character. This decreases the radiation beyond the wearer's immediate environment, especially at low frequencies which could be annoying to others, compared with in-phase systems.

Figure 3:
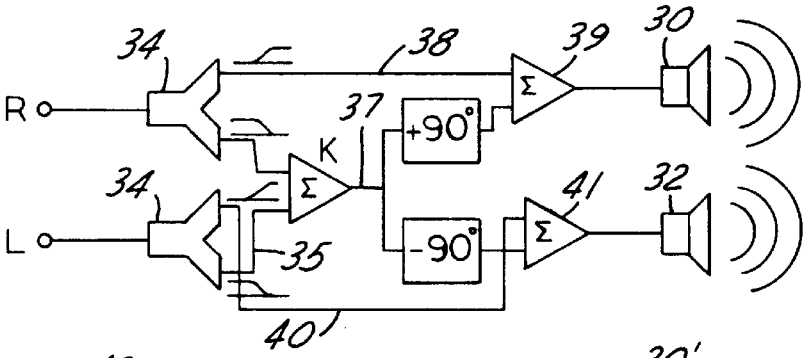
FIGS. 3 and 4 illustrate two filter networks for use with an embodiment of the present invention.
Figure 4:
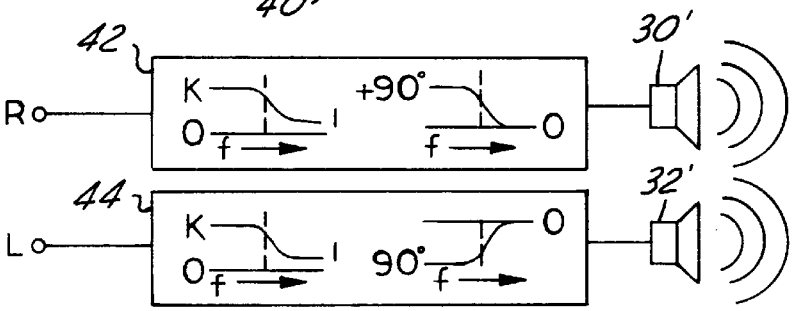

FIGS. 3 and 4 illustrate two proposed filter networks for driving a system incorporating the Type I embodiment of the present invention. In FIG. 3, a stereo pair of wearable dipole speakers 30 and 32 are driven in the dipole out-of-phase mode from the lowest frequencies to the cross-over frequency at which the "out-of-phase" response is nominally equal to the "in-phase" response. The signals for the right "R" and left "L" channels are passed through frequency splitters 34. The low frequency signals 35 from both the R and L channels are passed through summer 36 and multiplied by the gain K. The resultant signal 37 is applied to a +90° phase shifter and a −90° phase shifter. The resultant +90° phase-shifted signal is combined with the high frequency signal 38 at summer 39 for the R channel. The resultant −90° phase-shifted signals combined with high frequency signal 40 at summer 41 for the L channel. The speakers are driven in-phase at higher frequencies with shaped gain compensation to produce a uniform response. The transition shape and phase and gain can be adjusted to yield optimum subjective performance.

The system shown in FIG. 4 is the digital equivalent of the system shown in FIG. 3 and operates in a similar manner to get the same result. The signals for the right "R" and left "L" channels are electronically split in digital processing networks 42 and 44, respectively, into the high frequencies and low frequencies at the cross-over point (which is the resonant frequency of the transducer). The low frequency signals are then driven out-of-phase and combined with the in-phase high frequency signals. The resultant combined signals are then delivered to the speakers 30' and 32'.

The dipole speakers can be positioned on the wearer in a number of different ways. For example, the speakers could be positioned on the collar or upper shoulders of a shirt or other wearable garment. A system having both microphones and speakers in a shirt-type garment is shown in commonly owned co-pending U.S. application Ser. No. 280,185, the disclosure of which is hereby incorporated by reference.

As mentioned above, enhanced low frequency performance is achieved by either using two sources, one for each ear, which share a common sealed enclosure but are driven 180° out-of-phase (Type I), or a single source in an open enclosure where the vent or open end is placed as far as practicable from the ear (Type II). In the first embodiment, the back pressures cancel and the two sources individually behave as though they are mounted in an infinite volume enclosure. In the second embodiment, the transducer is situated near the ear, perhaps on the shoulder, and the open end is positioned as far from the ear as possible. Of course, the two ends may be reversed if that results in a preferred wearable configuration. That is, the open end may serve as the primary source. Typically, the open end source will yield less intensity at higher frequencies as a result of internal absorption. Therefore an additional high frequency transducer ("tweeter") for each ear may be required.

In either of the Type I or Type II embodiments where there are two transducers or a single transducer, the hollow enclosures are preferably designed with a shape and sufficient flexibility that they can be worn on the body in comfort. This conformal "softness" can be secured by filling the enclosure with a physically supporting but acoustically transparent material that will not significantly load the transducer due to acoustic back pressure. As mentioned above, open-cell foam materials have been shown to be satisfactory for this purpose.

FIGS. 5–8 show various arrangements of transducers in accordance with the present invention. These systems meet the requirements for "dipole operation," proximity to the wearer's ears, and mutual coupling between two transducers. Of course, a single transducer, or more than two, may be substituted for the pairs of transducers shown in these Figures.

Figure 16:
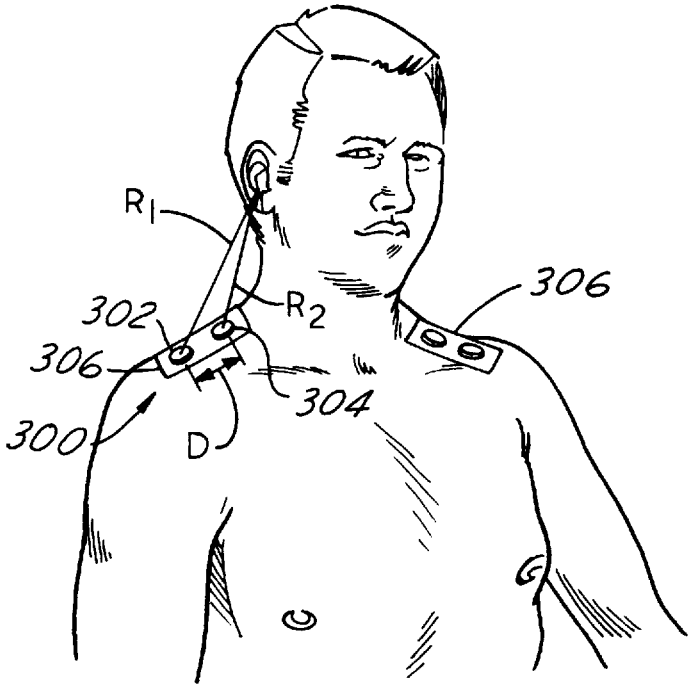
FIG. 16 illustrates an alternate embodiment of the invention which utilizes linear arrays of speakers.

Also, it is to be understood that the term "transducer" used herein can include (and preferably does include) arrays of two or more closely coupled transducers substituted for a single transducer in order to obtain increased audio output. Mutual coupling between equi-phased transducers in close proximity increases acoustic radiation efficiency, as is well known. An embodiment utilizing linear arrays of transducers is shown in FIG. 16 and described in more detail below.

Figure 5:
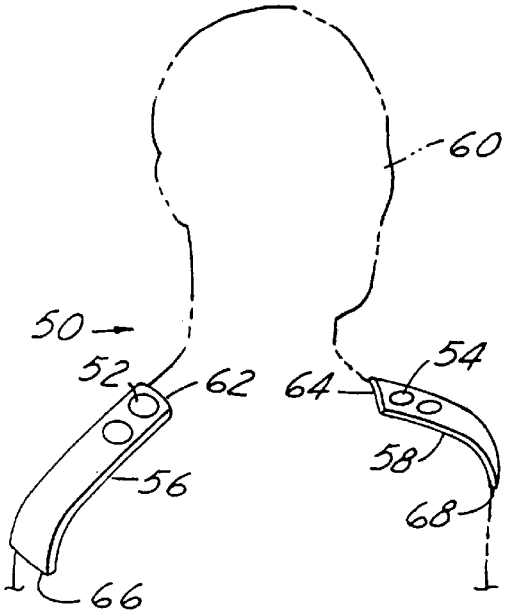
FIGS. 5–8 depict alternate possible wearable devices for use with the present invention.

FIG. 5 shows a Type II system 50 with a pair of "dipole" speakers or transducers 52 and 54. (As shown, each of transducers 52 and 54 comprise an array of two transducers.) The enclosures 56 and 58 are shaped and configured to mount on the shoulders of the wearer 60. The enclosures 56 and 58 are either hollow or filled with an acoustically transparent material as discussed above. Ends 62 and 64 of the enclosures are closed while ends 66 and 68 are open.

Figure 6:
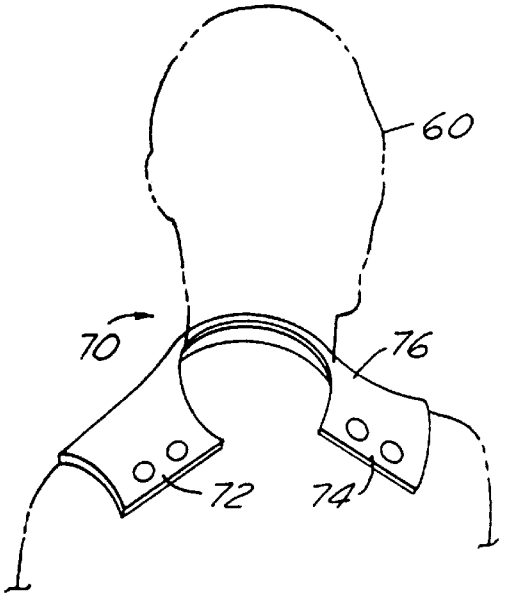

FIG. 6 shows a Type I system 70 utilizing two transducer arrays 72 and 74 mounted in a shared common enclosure 76. All of the ends or sides of the enclosure 76 are closed (sealed). The enclosure 76 is shaped and configured like a yoke and mounted around the rear of the neck of the wearer 60 with its ends having the transducers 72 and 74 positioned on the shoulders.

Figure 7:
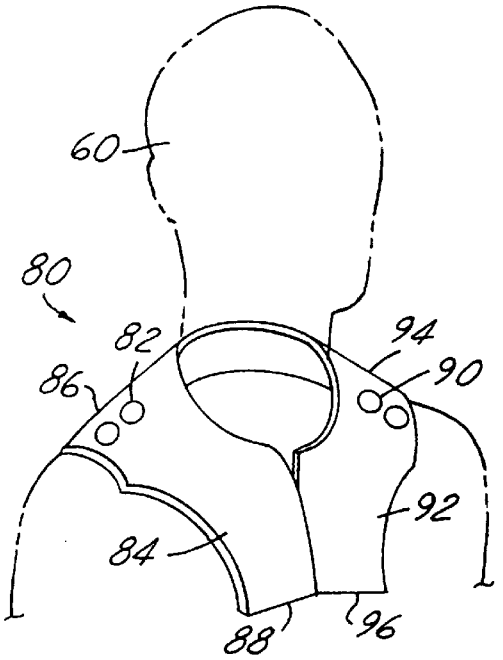
Figure 8:
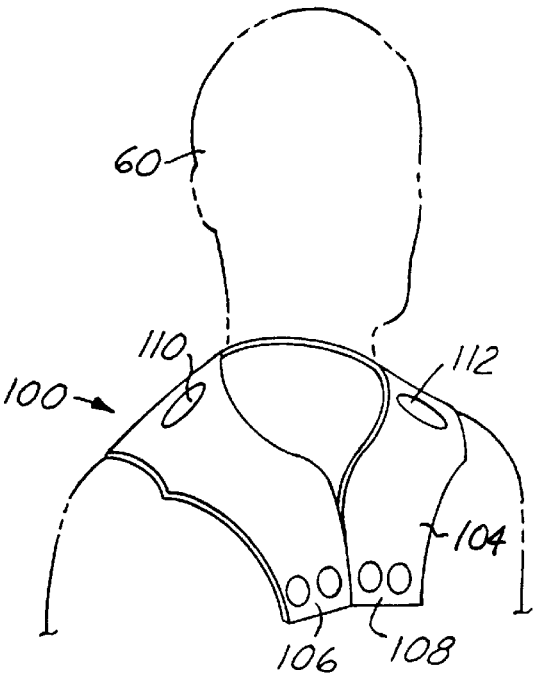

Other Type II systems are shown in FIGS. 7 and 8. In system 80 shown in FIG. 7, transducer array 82 is positioned in enclosure 84 having a closed end 86 at the rear of the wearer and an open end 88 on the lower chest of the wearer. Similarly, transducer array 90 is positioned in enclosure 92 having a closed end 94 and an open end 96. The system 80 is also shaped and configured like a yoke with the transducers on the shoulders of the wearer 60. Again, the enclosures 84, 92 are either hollow or filled with an acoustically transparent material.

In system 100 shown in FIG. 8, separate enclosures 102 and 104 are provided in a yoke-type configuration and are positioned and shaped to fit on the shoulders of the wearer 60. The transducer arrays 106 and 108 are positioned on one end of the enclosures 102 and 104. The enclosures are either hollow or filled with an acoustically transparent material. Rather than having open ends in the enclosures 102 and 104, vents 110 and 112 are provided. The vents are openings in the enclosures and have the same purpose and effect as open ends.

Although FIGS. 5–8 illustrate use of the present invention with a single independent enclosure or a pair of independent enclosures, it is to be understood that the enclosures can be integrated into various types of clothing, such as vests, jackets, shirts, sweatshirts, headbands, hats, helmets, scarfs, shawls or the like. This would make the system more easily wearable and usable by the wearer. The articles of clothing also would hide the transducers and enclosures from view.

In an alternate embodiment, transducers which are selected for optimum low frequency response can be combined with transducers which are better for higher frequencies. This provides improved over-all high fidelity performance. A cross-over network used to divide audio signals into appropriate bands for this purpose is shown in FIG. 9.

Figure 9:
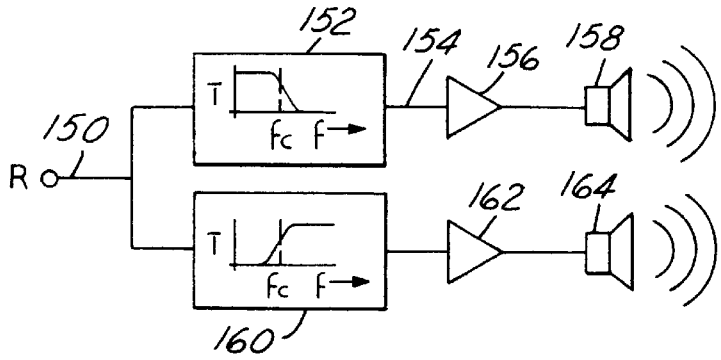
FIG. 9 illustrates a cross-over network for use with the present invention.

In FIG. 9 only the right channel "R" circuit diagram is shown, but it is understood that the circuit diagram for the left channel is identical. The audio signal 150 is fed into low pass filter 152 and the resultant signal 154 is amplified by amplifier 156 and used to drive the right "woofer" speaker 158. At the same time, the signal 150 is passed through high pass filter 160, amplified by amplifier 162 and used to drive the right "tweeter" speaker 164. The filters 152 and 160 can have either an analog or digital implementation.

The connections between the transducers and their power and driving sources may be accomplished by the use of wires or other conventional electrical connection devices. It is also possible to use wireless technology, such as radio frequency, infrared or inductive coupling in order to distribute the signals from audio sources to the transducer drive electronics.

Figure 10:
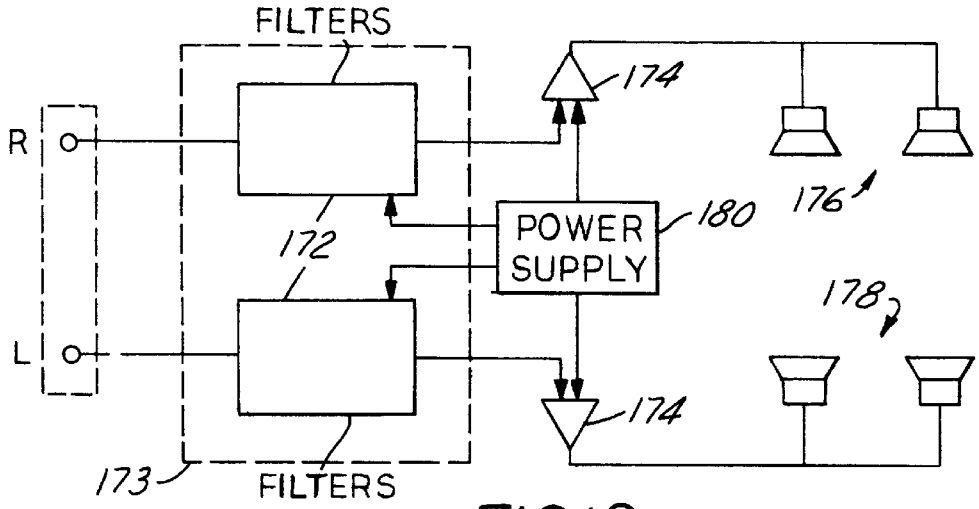
FIG. 10 schematically illustrates one system wherein the electronics are positioned in an enclosure.

The electronic circuitry and batteries for this system can be positioned in the hollow enclosures, in other portions of the wearable garment, or on other portions of the wearer's body. In this regard, complete radio, portable telephone, or cellular telephone systems could be integrated into the hollow enclosures. FIG. 10 is a schematic diagram of a basic system which could be utilized in accordance with the present invention and in which the electronics and other circuitry are mounted in an enclosure.

In FIG. 10, the right "R" and left "L" audio signals are introduced into the system at 170. The signals are then passed through equalization filters and preamplifiers 172 and driven by driver amplifiers 174. The resultant signals are sent to transducer arrays 176 and 178. Power supply 180 supplies the power for the filters, preamps and driver amps. The system shown in FIG. 10 is directed to a Type II embodiment of the invention. For a Type I embodiment, the portion of the system designated by the reference numeral 173 is replaced by the splitter and filter systems shown in FIGS. 3 or 4.

Figure 11:
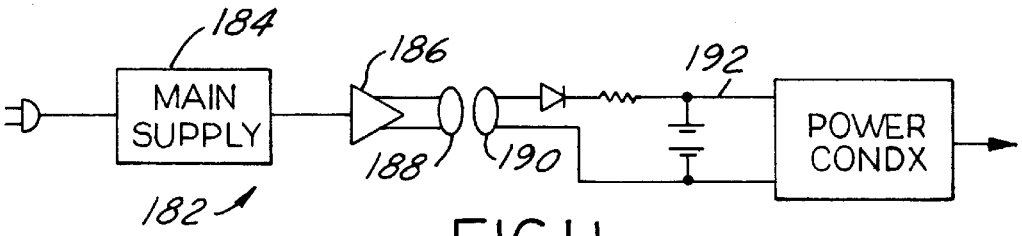
FIG. 11 illustrates an alternate power supply for the present invention.

The power supply 180 can be any one of a variety of conventional types of power supplies conventionally used for portable electronic products today. For example, the power supply could be one or more long life batteries. The power supply also could be a rechargeable battery which uses an inductive charging system 182, such as that shown in FIG. 11. In FIG. 11, the main power supply 184 is passed through a high frequency oscillator 186 and used to establish a charging frequency in coil 188. Receiving coil 190 in the headband or other wearable embodiment charges the battery 192 which in turn supplies power for the system.

Figure 12A:
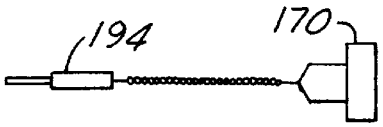
FIGS. 12A and 12B illustrate alternate devices for inputting the audio signal into the system.
Figure 12B:
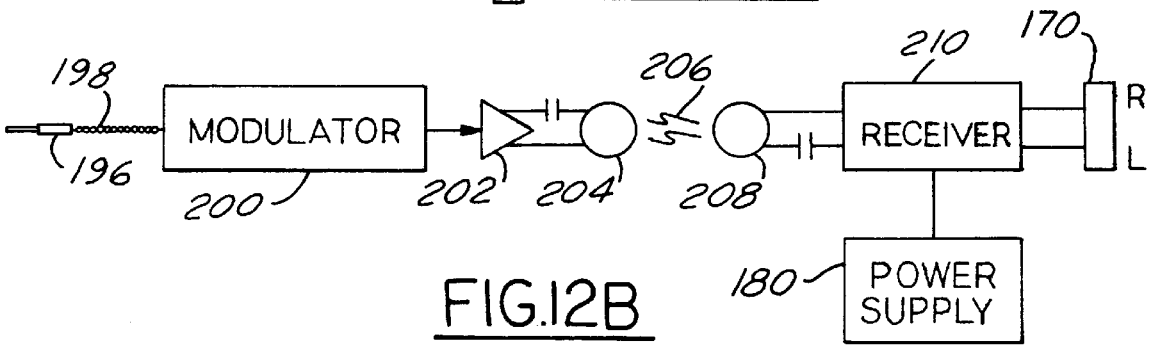

The audio input into the system 170 can be received from a variety of different systems, two of which are shown in FIGS. 12A and 12B. In FIG. 12A the source of the audio input is from a jack member 194 which is hard wired directly to the system 170. The jack member can be connected to an FM radio, a cassette tape player, a cellular telephone, a CD player, or any similar system.

FIG. 12B illustrates a wireless link version of the present invention, where the audio input is secured by inductive coupling. A jack member 196 is plugged into a conventional electronic audio source (such as an AM or FM radio, cassette tape player, CD player, digital audio tape player (DAT), a mini disc player, a digital cassette player (DDC), a portable telephone, a cellular telephone, a portable television, a head-mounted display system etc., or any other conventional communication system) and receives a stereo audio signal 198. The electronic source can be worn at the waist of the wearer, in a pocket, etc. The signal 198 is modulated by stereo FM modulator 200, driven by a radio frequency (RF) driver 202 and transmitted by transmitter wire coupling loop 204. The transmitted signals 206 are received by receiver coupling loop 208 and stereo FM receiver 210, which can be a single integrated circuit (IC). The receiver 210 is driven by power supply 180' which can be any conventional source, as discussed above with reference to power supply 180 (FIG. 10). The carrier for the receiver can be, for example, a 300 kHz carrier. Other methods of transferring signals across or to the body can be utilized, for example infrared and radio frequency systems such as those used in commercially available wireless headphones.

The audio system using the dipole transducer configuration of the present invention, could be controlled in any conventional manner. For example, controls could be mounted directly on the enclosures, or positioned at another site on the wearer connected by wires. One preferred position for placement of the control system is at the wrist of the wearer, either in the cuff of the garment or on a separate wristband, perhaps combined with timekeeping functions, i.e. a watch.

Figure 13:
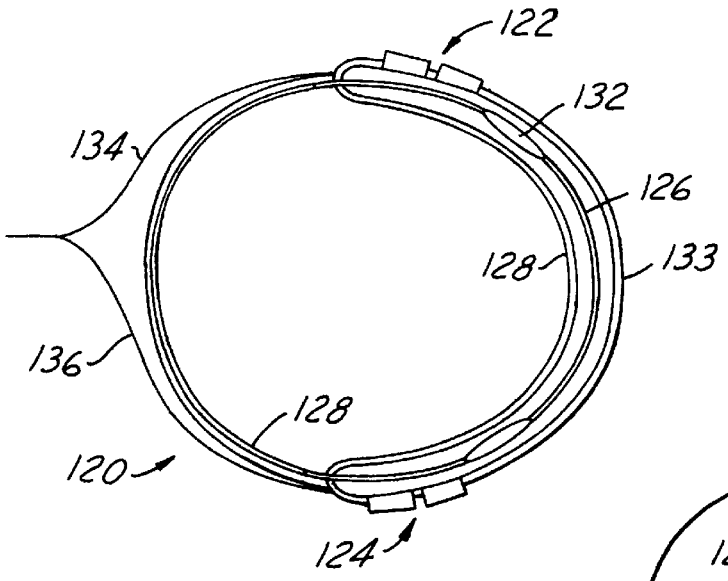
FIG. 13 illustrates a wearable form of the present invention where the invention is incorporated into a headband.

A preferred embodiment for use of the present invention is shown in FIG. 13. The invention is incorporated into a headband 120 and can be used for exercise, sports or any other activity desired.

In FIG. 13, a pair of transducers 122 and 124 are positioned on opposite sides of a headband 120. As set forth above, the transducer arrays could include less or more than a pair of speakers on each side of the headband. The transducers 122, 124 are positioned on opposite ends of an enclosure 126 which is hollow, filled with an open-cell foam, or filled with another acoustically transparent material. For wireless connection to audio sources, an inductive wire loop 128 can be provided around the circumference of the headband. An inductive coil (not shown) could also be provided in the headband, along with a battery or other power source.

Optionally, electronic modules 130, 132 can be provided in the enclosure 126. They can be attached to the inductive loop 128. The electronic modules contain one or more of the circuits described above.

The headband enclosure 126 is preferably covered with a soft or absorbent material 133 on both the inside and outside surfaces. A terry cloth type material 133 provides for absorbing and wicking perspiration from the wearer. This type of material is substantively transparent to the acoustic radiation and could cover the transducers 122–124 if desired for aesthetic reasons.

The transducers 122 and 124 can also be covered with a thin protective material (not shown) if desired. In order to protect the transducers from the moisture and inclement weather, they can be sealed by a thin diaphragm that is substantially acoustically transparent over the audio frequency range.

The transducers 122, 124 are positioned in the headband so that they will be positioned immediately above the ears of the wearer when the headband is worn. Preferably, the speakers or transducers 122, 124 are positioned above or just forward of the entrances of the ear canals of the wearer.

The physical contact between the transducer chamber walls and the wearer's temples promotes direct coupling of low audio frequencies to the head, thus producing an important pleasant subjective effect giving the impression of further extended low frequency response. In fact, head gear such as hats can be designed specifically to enhance this effect by ensuring that the transducer chamber walls snugly contact the temples, with a minimum of intervening fabric or other materials.

As shown, the enclosure portion 126 of the headband 120 is preferably arranged to partially encircle the head and be positioned toward the front of the wearer's head. However, the enclosure may alternatively be arranged toward the back of the head of the wearer, or encompass the entire circular headband.

The speaker enclosure structure with a foam core offers a satisfactory combination of good acoustical parameters, lightweight and conformable characteristics. For a Type I embodiment, the internal coupling between the transducers 122, 124, driven 180° out-of-phase at the two ears at lower frequencies, sets up a "dipole" operation which enhances the low frequency response. Electric drive is preferably accomplished by a network such as those shown in FIGS. 3 and 4.

For a first Type II embodiment, the transducers are operated in phase, but the enclosure is divided into two parts, one for each ear. An opening, or vent, is positioned in each part of the enclosure as far as possible from the wearer's ears. For a headband, the furthest points would be at the front center of the forehead of the wearer or at the rear center of the head.

In another Type II embodiment, a single (common) enclosure is provided. The enclosure has an opening or vent either in the front of the wearer's head or the back, about one-half way between the transducers.

Wires required to connect the transducers to the audio source are preferably arranged to emerge from the headband at a convenient place, preferably just behind the ears or at the back of the head. In FIG. 13, the wires are identified by the numerals 134 and 136.

Preferably, the electronics are encapsulated in the hollow portion of the headband 120 and embedded in the foam material. Power can be supplied to the system by a replaceable battery (not shown). The power can also be supplied by a permanent battery which is charged with a inductive coupler to an external charging supply as is well know. Also, the signal coupling loop could act additionally as a charging coupler by using appropriate filtering to separate signals at different frequencies. A basic circuit diagram for a system which can be used with the present invention is shown in FIG. 10. The system could be powered by the embodiments shown in FIGS. 11, 12A or 12B.

As indicated, the audio signals are applied to the transducers 122, 124 by means of a wire loop 128 embedded in the headband 120. The loop could have multiple turns and be arranged in a resonant circuit for optimum efficiency. The audio source, e.g. a tape player, is connected to a transmitter unit which terminates in another wire loop. Inductive coupling between the two loops creates a signal in the headband which is amplified and demodulated to produce a two-channel stereo signal which is then directed to the transducers. A typical carrier frequency for this system is 300 kHz. FM is the preferred modulation technique, providing inherent immunity to noise. However, other modulation techniques could be utilized, such as pulse width, pulse position, and the like, including methods for digital encoding which may incorporate encryption methods for security and privacy.

A headband system similar to that described above could be used for various entertainment and communication functions. Also, the audio system may be set up to report additional functions to the wearer, such as the time of day, pace, heart rate, etc. with a synthesized voice or other audio signal. The headband could also provide appropriate psychological conditioning messages.

Although the sports-related invention is shown and described above with reference to a headband 120, it is obvious that the present invention could be incorporated into other head-mounted wearable members, such as a cap, hat, helmet or the like. Moreover, the headband, hat, etc., could be used by wearers for various activities, other than merely sports or exercise related. For example, construction workers, homeowners, sports spectators and the like could wear one of the devices as a personal entertainment or communication system.

In this regard, the present invention could easily be adapted for use with a brimmed hat. An intimate dipole system could be provided with the speakers positioned on the brim with their plane horizontal rather than vertical. The foam-filled enclosure could be formed into a thick brim for the hat with the speakers or speaker grills positioned above the wearer's ears. (In this configuration, a concentrator might not be necessary because the transducers are directed toward the ears.) It is also possible, of course, to orient the transducers vertically in a brimmed hat configuration. This could be done simply by positioning an audio headband around the hat and providing openings or grills in the brim inbetween the transducers and the positions of the wearer's ears.

Figure 14:
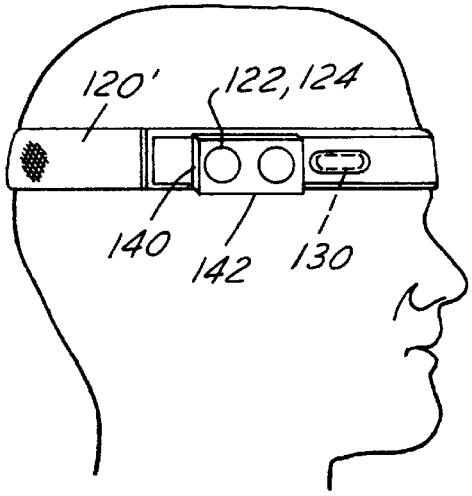
FIG. 14 illustrates an alternate headband embodiment.

As illustrated in FIG. 14, the transducers or speakers 122, 124 are oriented in line with the circumference of the headband 120'. When the headband is worn, much of the radiation is emitted in a direction away from the wearer's ears. In order to improve the audio transmission to the ears, a deflector or concentrator 140, as shown in FIG. 14, could be utilized. The deflector 140 is preferably made from a plastic material, and covers the areas of the speakers 122, 124 except for an opening 142 adjacent the ears of the wearer. For the headband 120' shown in FIG. 14, the opening is positioned downwardly.

With some head-mounted wearable members, such as a bicycle helmet, it is possible to incorporate the deflector or concentrator into the wearable structure. Bicycle helmets, for example, are commonly made from lightweight plastics which can be molded or machined to incorporate one or more coupling enclosures and concentrators.

In order to provide better bass response at frequencies of typically of 60–80 Hz, it may be desirable to use bass boost or equalization in the system. This drives more electrical power into the speakers or transducers below their effective resonance. Typically, an additional 12 dB boost of power can be used for each octave below resonance. This is known for high-end audio speaker systems.

It also is possible to use multiple transducers adjacent to each of the ears of the wearer. This would increase the bass response limits. The power handling improves proportionally to the number of transducers provided. Also, the mutual acoustic coupling at low frequencies enhances the effective radiation resistance and therefore the output beyond simple additive response. Although FIGS. 13 and 14 show headbands having one pair of transducers on each side of the wearer's head, more than two may be used adjacent each ear.

In order to increase the audio sound level, enhance the bass response, and prevent the sounds from bothering or being heard by others, it is possible to add ear flaps or ear cups of some type which direct the sounds from the transducers to the ears of the wearer. (FIG. 14 shows one form for accomplishing this.) It may be preferable to arrange the flaps or cups to be movable, allowing the wearer to change the degree of isolation from the surroundings.

Figure 15:
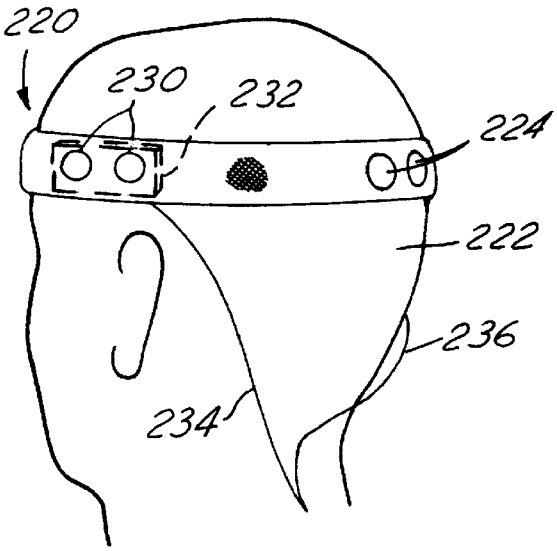
FIG. 15 shows a preferred form of a headband embodiment of the invention.

A headband 220 incorporating a prototype of the present invention was developed and is schematically shown in FIG. 15. In FIG. 15, the headband 220 is oriented on the wearer's head 222 with the back pressure vents 224 facing toward the back. It is also possible to wear the headband so that the vents 224 are oriented toward the front of the wearer's head.

Four 30 mm diameter transducers 230 (two for each ear) are utilized in the headband 220. The transducers used were taken from Sony model MDR-D33 headphones. The measured free-air resonant frequency of the transducers was 180 Hz. The transducers were glued in a Delrin component and encapsulated between two strips of adhesive-backed high density foam tape (3M type 4416). Holes were cut in the foam tape for the transducers. A ⅜" thick open-cell foam core (Atlas Foam Products type A172C) was cut to a width of 1.4" and a length of about 11". The core was encapsulated by the same strips of foam adhesive tape to form a half headband structure (similar to that shown in FIG. 13). A pair of acoustic concentrators 232 were fabricated from Delrin and secured over each set of two speakers.

The speakers were driven in phase directly by wires 234 and 236. Center vents 224 for the speaker back pressures were provided by cutting holes in the tape at a location which was centered near the back (or front) of the head when the headband was worn, i.e. at the furthest point from the ears. Extensions of the band with Velcro-type fasteners secured the two ends of the headband together and also provided adjustment for comfort and different sized heads.

The speakers were driven with a conventional amplifier and a conventional ⅓ octave graphic equalizer adjusted to provide a tapered 12 db of bass boost below 160 Hz, as described above. This prototype yielded satisfactory results which were competitive with high quality headphones. In fact, in some cases, the "sound stage spatialization" sensation was superior to that produced by standard headphones. The pleasant effect of apparent additional low frequency extension due to direct coupling into the temples was also noted.

FIG. 16 shows an alternate system which provides low frequency response and improved smoothness of high frequencies for wearable speakers. As indicated, it is necessary to have the transducers and structures be conformal, that is, to adapt to the shape of the wearer's body for reasons of comfort and for considerations of fashion and social acceptability. This means that the transducers and supporting structures must be relatively small in size and weight. Small speakers, however, often have difficulty in creating acceptable high fidelity sound due to limitations in the maximum excursion prior to severe distortion of the diaphragms. Power considerations in wearable systems also limit their effectiveness, either due to the size of the speakers, the power supply itself, or the distances that the audio must travel between the system and the wearer's ears.

As shown in FIG. 16, an array 300 of two or more speakers 302 and 304 are positioned in prespecified locations and utilized as the transducer for the system. When two or more transducers are mounted in close proximity to one another, they acoustically couple at low frequencies to yield effectively greater radiation. For example, two adjacent transducers can produce a net radiation which is twice that of a single transducer driven at the same total input power. Further, each of the two transducers can be driven at its own limits, yielding a net radiated power which is four times that of a single transducer.

The speakers 302 and 304 are positioned as an array on the wearer's shoulders, like an epaulet. Design and use considerations effectively limit the diameters of the speakers to about 5 cm, and to a linear positioning along the line of the shoulder.

The mutual coupling provides enhanced low frequency performance. A linear transducer array similar to that shown in FIG. 16 can be used in place of the transducers or arrays described above.

Mutual coupling is effective for two transducers 302 and 304 up to approximately 5000 Hz. The effective upper frequency limit "$f_o$" is given approximately by the following equation:

$$f_o = \frac{C}{2D} \sqrt{n}$$

where C is the speed of sound, D is the nominal spacing between the transducers, and n is the number of coupled transducers. For example, if D=5 cm and n=2, then $f_o$=4800 Hz.

A linear array of speakers along a wearer's shoulders will be operating "off axis". This means that the ears will receive direct radiation from a direction other than along a plane perpendicular to the line connecting the speakers. This will produce some interference. The interference effects become important when the wave length of the sound becomes approximately ¼ of the separation distance D between the speakers. The result can be substantial variations of received intensity versus frequency. For typical wearable geometries, this will occur at frequencies above approximately 1000 Hz.

In order to avoid the interference effects, the signals which drive the individual speakers in an array are time-delayed with respect to one another. This compensates for the differences in distance from a transducer to the closest ear. For example, the two transducer array 300 shown in FIG. 16 has a time delay of $$(t_1-t_2)=(R_1-R_2/C)$$

The time delays are maintained approximately constant regardless of frequency. It is also possible to introduce the time delays only at the higher frequencies since the directivity at low frequencies is very low. The time delays can be performed by any standard technique, such as use of a fixed length taped FIFO shift register or a general purpose digital sound processor ("DSP"). If a DSP is used, it could also be used for frequency response equalization and "sound stage" enhancement via cross-channel mixing.

Phased transducer arrays also have increased efficiency since the radiated acoustic poser is concentrated in the direction of the ear. Further, directing the radiation toward the wearer's ears enhances privacy and lessens the disturbances to others.

Two or more transducers can be utilized in each linear array of transducers (two are shown in FIG. 16). Also, the arrays of transducers can be mounted on a housing, platform 306 or the like which can be separate, or included as part of a wearable garment, such as a shirt. Preferably, the platform 306 is pliable or conformable, so it can be confirmed to the body of the wearer for ease of use and non-obtrusiveness. The platform can also consist of a housing or similar structure, either open-ended or closed, and which can be filled with an acoustically transparent material, such as open cell foam.

The transducers 302 and 304 in each of the linear arrays 300 are connected to conventional power and driving sources (not shown) . These sources are positioned at other portions or in other areas of the wearer's body, such as in a pocket, on a waistband, on a hand-held device, etc. Also, the transducers are connected to the sources by wires, any other conventional electrical connection devices, or by wireless technology. These matters are described in more detail above.

Although particular embodiments of the present invention have been illustrated in the accompanying drawings and described in the foregoing detailed description, it is to be understood that the present invention is not to be limited to just the embodiments disclosed, but that they are capable of numerous rearrangements, modifications and substitutions without departing from the scope of the claims hereafter.

It is claimed:

1. A personal wearable, portable communication and entertainment system comprising:

a hollow, closed structural member;

a first transducer means mounted on said structural member;

second transducer means mounted on said structural member;

said first and second transducer means positioned in spaced relation to each other on said structural member;

driver means for driving said first and second transducer means with driving signals, said first and second transducer means being driven 180 degrees out-of-phase at a first frequency range and being driven in-phase at a second frequency range;

said first frequency range being lower than said second frequency range;

means for supplying audio signals to said first and second transducer means; and means for changing the relative phase of driving signals from said driving means when the out-of-phase response would have been approximately the same as the in-phase response;

wherein each of said first and second transducer means, comprises a linear array of at least two speakers and wherein said system further comprises time-delay means which delays sending the audio signal to the speakers of each linear array of speakers in a preselected sequence;

whereby the response of said system in said first frequency range is enhanced.

2. The personal wearable, portable communication system of claim 1 wherein said structural member is filled with an acoustically transparent material other than air.

3. The personal wearable, portable communication system of claim 2 wherein said material is an open cell foam.

4. The personal wearable, portable communication system of claim 1 wherein said first frequency range comprises about 20–200 Hz.

5. The personal wearable, portable communication system of claim 1 wherein said system is adapted to be worn by a wearer and produces an audio output while not covering the ears of the wearer or blocking environmental sounds to the wearer.

6. The personal wearable, portable communication system of claim 1 wherein said structural member is made from a flexible, pliable material and can be formed to conform to a portion of the wearer's body.

7. The personal wearable, portable communication system of claim 1 wherein said means for supplying audio signals is selected from the group comprising a CD player, radio, digital audio tape player, digital cassette carrier, mini-disc player, telephone, television and cassette tape player.

8. The personal wearable, portable communication system of claim 1 wherein said means for changing the relative phase of driving signals comprises a crossover network and a 180 degree phase shift network.

9. The personal wearable, portable communication system of claim 8 wherein said means for changing the relative phase of driving signals comprises a digital signal processing system.

10. A personal wearable, portable communication and entertainment system comprising:

a first hollow structural member;

a first linear array of at least two transducers mounted on said first structural member;

said first structural member having a first acoustic aperture in spaced relation to said first transducer means;

a second hollow structural member;

a second linear array of at least two transducers mounted on said second structural member;

said second structural member having a second acoustic aperture in spaced relation to said second transducer means;

driver means for driving said first and second linear arrays of transducers;

means for supplying audio signals to said first and second linear arrays of transducers; and time-delay means for sequential sending of such audio signals to each of the transducers in each of said first and second linear arrays of transducers;

whereby when said system is worn with the first linear array of transducers being positioned adjacent, but not blocking or covering one of the wearer's ears, the second linear array of transducers being positioned adjacent, but not blocking or covering the other of the wearer's ears, and the first and second apertures each being positioned at a distance further from the wearer's ears than the respective first and second linear arrays of transducers, the system provides a low frequency response which approximates that provided by conventional headphones and earphones that cover the wearer's ears and significantly block external sounds to the ears.

11. The personal wearable, portable communication system of claim 10 wherein said first and second structural members are each filled with an acoustically transparent material other than air.

12. The personal wearable, portable communication system of claim 11, wherein said material is an open cell foam.

13. The personal wearable, portable communication system of claim 10 wherein said first and second structural members are each made from a flexible, pliable material and can be formed to conform to a portion of the wearer's body.

14. The personal wearable, portable communication system of claim 10 wherein said means for supplying audio signals is selected from the group comprising a CD player, radio, digital audio tape player, digital cassette carrier, mini-disc player, telephone, television and cassette tape player.

15. The personal wearable, portable communication system of claim 10 wherein said first and second apertures each comprise a vent and said apertures are positioned relative to said first and second transducer means at the furthest possible position on said first and second structural members from a wearer's ears when the system is worn.

16. A personal wearable, portable communication and entertainment system comprising:

a hollow structural member;

first and second transducer means mounted in spaced relation on said structural member;

each of said first and second transducer means comprising a linear array of at least two speakers;

said structural member having at least one acoustic aperture positioned between said first and second transducer means;

driver means for driving said first and second transducer means;

means for supplying audio signals to said first and second transducer means; and time-delay means for sequential sending of such audio signals to each of the speakers in each of said first and second transducer means;

whereby when the system is worn with the first transducer means being positioned adjacent, but not blocking or covering one of the wearer's ears, the second transducer means being positioned adjacent, but not blocking or covering the other of the wearer's ears, and said aperture is positioned farther away from the wearer's ears than said first and second transducer means, the low frequency response of said system approximates that provided by conventional headphones and earphones that cover the wearer's ears and significantly block external sounds to the ears.

17. The personal wearable, portable communication system of claim 16 wherein said structural member is made from a flexible, pliable material and can be formed to conform to a portion of the wearer's body.

18. The personal wearable, portable communication system of claim 16 wherein said means for supplying audio signals is selected from the group comprising a CD player, radio, digital audio tape player, digital cassette carrier, mini-disc player, telephone, television and cassette tape player.

19. The personal wearable, portable communication system of claim 17 wherein said structural member is incorporated into a wearable garment and said first transducer means is adapted to be positioned on one shoulder of a wearer and said second transducer means is adapted to be positioned on the other shoulder of a wearer.

20. The personal wearable, portable communication system of claim 16 wherein at least two apertures are provided in said structural member, one aperture corresponding to said first transducer means and the other aperture corresponding to said second transducer means.

21. The personal wearable, portable communication system of claim 16 wherein when said system is worn by a wearer, said aperture is positioned further from the wearer's ears than said first and second transducer means.

22. A personal wearable, portable communication and entertainment system comprising:

a hollow, closed structural member;

a first transducer means mounted on said structural member;

a second transducer means mounted on said structural member;

said first and second transducer means positioned in spaced relation to each other on said structural member;

driver means for driving said first and second, transducer means with driving signals, said first and second transducer means being driven 180 degrees out-of-phase within a first frequency range and being driven in-phase within a second frequency range;

said first frequency range being lower than said second frequency range;

means for supplying audio signals to said first and second transducer means; and means for changing the relative phase of driving signals from said driving means when the out-of-phase response would have been approximately the same as the in-phase response;

said structural member sized to be positioned on a wearer's torso adjacent the head and shaped to conform to the wearer's torso;

wherein said structural member is positioned on the wearer's torso, said first transducer means is positioned adjacent one of the wearer's ears and said second transducer means is positioned adjacent the other of the wearer's ears;

wherein each of said first and second transducer means comprises a linear array of at least two speakers and wherein said system further comprises time-delay means which delays sending the audio signal to the speakers of each linear array of speakers in a preselected sequence;

whereby the response of said system in said first frequency range is enhanced.

23. The personal wearable, portable communication and entertainment system of claim 22 wherein said structural member is incorporated into an item of clothing adapted to be worn on the torso of the wearer.

24. The personal wearable, portable communication and entertainment system of claim 22 wherein said structural member is made from a flexible, pliable material and can be formed to conform to a portion of the wearer's torso.

25. The personal wearable, portable communication and entertainment system of claim 22 wherein said means for supplying audio signals is selected from the group comprising a CD player, radio, digital audio tape player, digital cassette carrier, mini-disc player, telephone, television and cassette tape player.

26. A personal wearable, portable communication and entertainment system comprising:

a first hollow structural member;

a first linear array of transducers mounted on said first structural member;

said first structural member having a first acoustic aperture in spaced relation to said first linear array of transducers;

a second hollow structural member;

a second linear array of transducers mounted on said second structural member;

said second structural member having a second acoustic aperture in spaced relation to said second linear array of transducers;

driver means for driving said first and second linear arrays of transducers;

means for supplying audio signals to said first and second linear arrays of transducers; and time-delay means for sequential sending of such audio signals to each of the transducers in each of said first and second linear arrays of transducers;

said first and second structural members being sized to be positioned on a wearer's torso adjacent the head and each being shaped to conform to the wearer's torso;

whereby when said system is worn with the first linear array of transducers being positioned on the torso adjacent one of the wearer's ears, the second linear array of transducers being positioned on the torso adjacent the other of the wearer's ears, and the first and second apertures being each positioned farther away from the wearer's ears, the system provides to the wearer a low frequency response which approximates that provided by conventional head phones and ear phones that cover the wearer's ears and significantly block external sounds to the ears.

27. The personal wearable, portable communication and entertainment system of claim 26 wherein said first and second structural members are each filled with an acoustically transparent material other than air.

28. The personal wearable, portable communication and entertainment system of claim 27, wherein said material is an open cell foam.

29. The personal wearable, portable communication and entertainment system of claim 26 wherein said first and second structural members are both incorporated into a single item of clothing adapted to be worn on the torso of the wearer.

30. The personal wearable, portable communication and entertainment system of claim 26 wherein said first and second structural members are each made from a flexible, pliable material and can be formed to conform to a portion of the wearer's torso.

31. The personal wearable, portable communication and entertainment system of claim 26 wherein said means for supplying audio signals is selected from the group comprising a CD player, radio, digital audio tape player, digital cassette carrier, mini-disc player, telephone, television and cassette tape player.

32. The personal wearable, portable communication and entertainment system of claim 26 wherein said first and second apertures each comprise a vent and said apertures are positioned relative to said first and second transducer means at the furthest possible positions and said first and second structural members away from a wearer's ears when the system is worn.

33. The personal wearable, portable communication and entertainment system of claim 26 wherein said acoustically transparent material comprises at least a portion of a high frequency damping material.

34. A portable device for wearing on the head of a wearer, said device comprising:

first and second hollow structural members incorporated in said device and positioned to lie adjacent opposed portions of the wearer's head when said device is worn;

a first and second transducer means mounted on said first and second structural members, respectively;

each of said first and second transducer means comprising a linear array of at least two speakers;

said first structural member having a first acoustic aperture in spaced relation to said first transducer means; and said second structural member having a second acoustic aperture in spaced relation to said second transducer means;

driver means for driving said first and second transducer means;

means for supplying audio signals to said first and second transducer means; and time-delay means for sequential sending of such audio signals to each of the speakers in each of said first and second transducer means;

whereby when said device is worn on the wearer's head with the first transducer means being positioned adjacent, but not blocking or covering one of the wearer's ears, the second transducer means being positioned adjacent, but not blocking or covering the other of the wearer's ears, and the first and second apertures each being positioned at a distance further from the wearer's ears than the respective first and second transducers, the system provides a low frequency response which approximates that provided by conventional headphones and earphones that cover the wearer's ears and significantly block external sounds to the ears.

35. The personal portable communication device of claim 34 wherein each of said first and second structural members are filled with an acoustically transparent material other than air.

36. The personal portable communication device of claim 35 wherein said material is an open cell foam.

37. The personal portable communication device of claim 34 wherein each of said first and second structural members is made from a flexible, pliable material and can be formed to conform to a portion of the wearer's head.

38. The personal portable communication device of claim 34 wherein said means for supplying audio signals is selected from the group comprising a CD player, radio, digital audio tape player, digital cassette carrier, mini-disc player, telephone, television and cassette tape player.

39. The personal portable communication device of claim 34 wherein said first and second structural members are incorporated into a wearable accessory selected from the group comprising a hat, a cap, a helmet, a scarf and a headband.

* * * * *